US012448772B1

(12) United States Patent
Bersano et al.

(10) Patent No.: US 12,448,772 B1
(45) Date of Patent: Oct. 21, 2025

(54) MODULAR CONSTRUCTION SYSTEM FOR PERMANENT FORMWORK

(71) Applicant: O. B. Bersano Group Ltd, Even Yehuda (IL)

(72) Inventors: Oran A. Bersano, Even Yehuda (IL); Eliyahu Shoshani, Pardes Hana (IL)

( * ) Notice: Subject to any disclaimer, the term of this patent is extended or adjusted under 35 U.S.C. 154(b) by 0 days.

(21) Appl. No.: 19/078,344

(22) Filed: Mar. 13, 2025

(51) Int. Cl.
*E04B 2/86* (2006.01)

(52) U.S. Cl.
CPC .... *E04B 2/8647* (2013.01); *E04B 2002/8676* (2013.01)

(58) Field of Classification Search
CPC ..... E04B 2/86; E04B 2/8611; E04B 2/8635; E04B 2/8647; E04B 2002/8676
See application file for complete search history.

(56) References Cited

U.S. PATENT DOCUMENTS 4,866,891 A * 9/1989 Young ..... E04B 2/8641 52/426
5,390,459 A 2/1995 Mensen
6,070,380 A 6/2000 Meilleur
9,151,053 B2 10/2015 Stephens, Jr.
9,238,910 B2 1/2016 Jensen
2004/0200177 A1* 10/2004 Okumura ..... C08L 67/02 52/633
2005/0023432 A1* 2/2005 Huber ..... E04G 9/05 249/34
2009/0211175 A1* 8/2009 Guidos ..... E06B 1/363 52/656.1
2010/0154321 A1* 6/2010 Javierre Lardies ..... E04C 3/34 52/340
2011/0107702 A1* 5/2011 Koikas ..... E04C 2/36 52/426

(Continued)

FOREIGN PATENT DOCUMENTS

EP 1705302 A2 * 9/2006 ..... E04B 2/8635
JP H09273253 A 10/1997

OTHER PUBLICATIONS

Wall paneling System, https://iqubx.com/wall=paenling. Aug. 4, 202 (wayback machine).

(Continued)

*Primary Examiner* — Christine T Cajilig
(74) *Attorney, Agent, or Firm* — Shlomo Horowitz; Shlomo Horowitz Patents and Intellectual Property Ltd.

(57) ABSTRACT

A modular wall is a permanent external frame solution for a building. It includes outer panels and inner panels each made of high impact thermoplastic polymer, eliminates the need for removable formwork, reduces construction time and improves insulation and waterproofing. The panels join together in a locking connection by snapping or sliding an end of a first panel to an opposite end of an adjacent second panel. Reinforcing metal pipes connecting each outer panel to a corresponding inner panel occupy a negligible amount of space where the concrete is to be poured so as not to obstruct rebar. Quality control is enhanced since the panels may be transparent to monitor the concrete casting. Each of the outer panels and inner panels may include two substantially parallel walls separated by a pattern of reinforcing ribs that together with the substantially parallel walls define spaces for heat insulation and increase structural integrity.

25 Claims, 6 Drawing Sheets

(56) References Cited

U.S. PATENT DOCUMENTS

| | | | | |
|---|---|---|---|---|
| 2012/0247046 | A1* | 10/2012 | Jewett | E04B 2/8635 52/426 |
| 2014/0318062 | A1* | 10/2014 | Richardson | E04B 2/8652 52/309.1 |
| 2017/0175407 | A1* | 6/2017 | Richardson | E04B 1/6116 |

OTHER PUBLICATIONS

Foam Permanent Mold System, youtube.com/shorts/Tup-CE35fyg. Sep. 13, 2023.
Not-remove the concrete mold youtube.com/shors/yz21ndplra, Apr. 5, 2024.
https://epiplastics.com, Jun. 12, 2024 (wayback machine).
https://nuformdirect.com/products, Aug. 12, 2024 (wayback machine).
https://octaform.com/applications/wall-ceiling-panels/ Apr. 23, 2024 (wayback machine).

* cited by examiner

Detail A

SECTION A-A

MODULAR CONSTRUCTION SYSTEM FOR PERMANENT FORMWORK

FIELD OF THE INVENTION

The invention is in the field of construction, for example apparatuses and methods for constructing the external formwork of a building, and in particular such apparatuses and method that employ modular wall panels made of polymers to use in a permanent formwork.

BACKGROUND OF THE INVENTION

Currently, the workers building a frame of a building such as a house, place parallel vertical wood panels, then insert between the panels a network of metal wires to strengthen the concrete. Then, the workers pour the concrete inside the gap between the wood panels. The workers then remove the wood panels, because the wood panels are reusable. Removing the wood panels is a task that takes a lot of time and labor. Also, it is necessary to then add an outer sealing layer against water on the outside surfaces of the concrete.

SUMMARY OF THE EMBODIMENTS

One embodiment is a modular wall that is a permanent external formwork of a building, comprising:

- a series of outer panels made of a thermoplastic polymer, each of the outer panels having a first end and an opposite end;
- a series of inner panels substantially parallel to the outer panels and made of the thermoplastic polymer or another thermoplastic polymer, each of the inner panels having a first end and an opposite end;
- reinforcing metal pipes connecting each outer panel to a corresponding inner panel, the reinforcing pipes occupying less than 5% of a space between the corresponding inner panel and the corresponding outer panel;
- a first end of a first outer panel is configured to fit into an opposite end of a second outer panel either using a sliding motion or using a snapping motion to form a first locking connection,
- a first end of a first inner panel is configured to fit into an opposite end of a second inner panel either using a sliding motion or using a snapping motion to form a second locking connection,
- wherein the inner panels and the outer panels are configured to remain in place as a permanent structure after a casting of concrete.

In some embodiments, the first end of each outer panel comprises a projecting head and the opposite end of each outer panel comprises a flange such that the first locking connection is able to be implemented by either (A) positioning the first end of the first outer panel and the opposite end of the second outer panel facing each other at an angle, inserting a tooth of the projecting head that exists on a side distal to the space beyond the flange and snapping the first outer panel into the second outer panel or (B) positioning the first end of the first outer panel and the opposite end of the second outer panel one above the other, inserting the projecting head beyond the flange and sliding the first outer panel into the second outer panel. In some embodiments, one or both of the outer panels and the inner panels are transparent.

In some embodiments, one or both of the outer panels and the inner panels are transparent.

In some embodiments, the first end of each outer panel comprises a projecting head having symmetrical teeth distal to and proximal to the space, and the opposite end of each outer panel comprises a flange, such that the first locking connection is implemented by positioning the first end of the first outer panel and the opposite end of the second outer panel one above the other, inserting the projecting head beyond the flange and sliding the first outer panel into the second outer panel.

In some embodiments, at least one of the series of outer panels and the series of inner panels comprises a transparent polypropylene homopolymer.

In some embodiments, each of the outer panels and each of the inner panels comprise two substantially parallel walls separated by a pattern of reinforcing ribs that together with the substantially parallel walls define spaces for heat insulation.

In some embodiments, the spaces are substantially triangular.

In some embodiments, the modular wall further comprises external supports attached to the outer panel and to the inner panel, wherein the reinforcing pipes are configured to attach to the external supports during a stage of a pouring of the concrete.

In some embodiments, at least some of either the inner panels or the outer panels are shaped to include a U-shaped projection, wherein a leg of the "U" of the U-shaped projection is substantially perpendicular to an inner panel or to an outer panel that the U-shaped projection projects from and wherein the U-shaped projection projects toward an area between the inner panels and the outer panels.

In some embodiments, the reinforcing metal pipes occupy less than 3% of the space.

In some embodiments, the modular wall further comprises a silicone gasket between opposite outer walls of each panel of one or both of the outer panels and inner panels.

Another embodiment is a modular wall that is a permanent external formwork of a building, comprising:

- a series of outer panels made of a thermoplastic polymer, each of the outer panels having a first end and an opposite end;
- a series of inner panels substantially parallel to the outer panels and made of the thermoplastic polymer or another thermoplastic polymer, each of the inner panels having a first end and an opposite end;
- a first end of a first outer panel fits into an opposite end of a second outer panel using either a sliding motion or a snapping motion to form a first locking connection,
- a first end of a first inner panel fits into an opposite end of a second inner panel using either a sliding motion or a snapping motion to form a second locking connection,
- wherein the inner panels and the outer panels are configured to remain in place as a permanent structure after a casting of concrete.
- wherein the first end of the first outer panel comprises a projecting head and the opposite end of the second outer panel comprises a flange such that the first locking connection is implemented by positioning the first end of the first outer panel and the opposite end of the second outer panel facing each other or with one above the other, inserting the projecting head beyond the flange and sliding or snapping the first outer panel into the second outer panel.

In some embodiments, the first end of each outer panel comprises a projecting head and the opposite end of each outer panel comprises a flange such that the first locking connection is able to be implemented by either (A) positioning the first end of the first outer panel and the opposite end of the second outer panel facing each other at an angle, inserting a tooth of the projecting head that exists on a side distal to the space beyond the flange and snapping the first outer panel into the second outer panel or (B) positioning the first end of the first outer panel and the opposite end of the second outer panel one above the other, inserting the projecting head beyond the flange and sliding the first outer panel into the second outer panel. In some embodiments, one or both of the outer panels and the inner panels are transparent.

In some embodiments, one or both of the outer panels and the inner panels are transparent or translucent.

In some embodiments, the first end of each outer panel comprises a projecting head having symmetrical teeth distal to and proximal to the space, and the opposite end of each outer panel comprises a flange, such that the first locking connection is implemented by positioning the first end of the first outer panel and the opposite end of the second outer panel one above the other, inserting the projecting head beyond the flange and sliding the first outer panel into the second outer panel.

In some embodiments, each of the outer panels and each of the inner panels comprise two substantially parallel walls separated by a pattern of reinforcing ribs that together with the substantially parallel walls define spaces for heat insulation.

In some embodiments, wherein at least some of either the inner panels or the outer panels are shaped to include a U-shaped projection, wherein a leg of the "U" of the U-shaped projection is substantially perpendicular to an inner panel or to an outer panel that the U-shaped projection projects from and wherein the U-shaped projection projects toward an area between the inner panels and the outer panels.

In some embodiments, the modular wall further comprises external supports attached to the outer panel and to the inner panel, wherein the reinforcing pipes are configured to attach to the external supports during a stage of a pouring of the concrete.

A further embodiments is a method of constructing a permanent external building wall, comprising:

setting in place in a vertical position a series of outer panels made of a thermoplastic polymer, a first end of each outer panel comprising a projecting head and an opposite end comprising a flange, such that a first end of a first outer panel connects to an opposite end of an adjacent second outer panel using a sliding motion or a snapping motion to form a first locking connection;

setting in place in a vertical position a series of inner panels substantially parallel to the outer panels and made of the thermoplastic polymer or another thermoplastic polymer, a first end of each inner panel comprising a projecting head and an opposite end comprising a flange, such that a first end of a first inner panel connects to an opposite end of an adjacent second inner panel using the sliding motion or the snapping motion to form a second locking connection, wherein one or both of the outer panels and the inner panels are transparent;

attaching reinforcing metal pipes to the outer panels and to corresponding portions of the inner panels, the reinforcing pipes occupying less than 5% of a space between each particular outer panel of the series of outer panels and a particular inner panel of the series of inner panels that faces the particular outer panel;

pouring concrete between the inner panels and the outer panels so as to occupy the space between the series of outer panels and the series of inner panels, wherein the inner panels and the outer panels are configured to remain in place as a permanent structure after the concrete has been cast.

In some embodiments, the method further comprises forming the first locking connection by either (A) positioning the first end of the first outer panel and the opposite end of the second outer panel facing each other at an angle, inserting a tooth of the projecting head that exists on a side distal to the space beyond the flange and snapping the first outer panel into the second outer panel or (B) positioning the first end of the first outer panel and the opposite end of the second outer panel one above the other, inserting the projecting head beyond the flange and sliding the first outer panel into the second outer panel.

In some embodiments, the method further comprises controlling a quality of the permanent external building wall by monitoring the pouring of the concrete by looking through at least one of the outer panels and the inner panels during the pouring of the concrete, wherein at least one of the outer panels and the inner panels are transparent, to identify at least one of defects, large air pockets and inconsistencies in either material density or concrete distribution.

In some embodiments, the method further comprises providing the outer panels and the inner panels with two substantially parallel walls separated by a pattern of reinforcing ribs that together with the substantially parallel walls define spaces for heat insulation.

In some embodiments, the method further comprises attaching external supports to the outer panels and to the inner panels so as to connect the outer panels and the inner panels to the reinforcing pipes during the pouring of the concrete.

BRIEF DESCRIPTION OF THE DRAWINGS

Various embodiments are herein described, by way of example only, with reference to the accompanying drawings, wherein.

DETAILED DESCRIPTION OF THE EMBODIMENTS

Figures 1A, 1B:
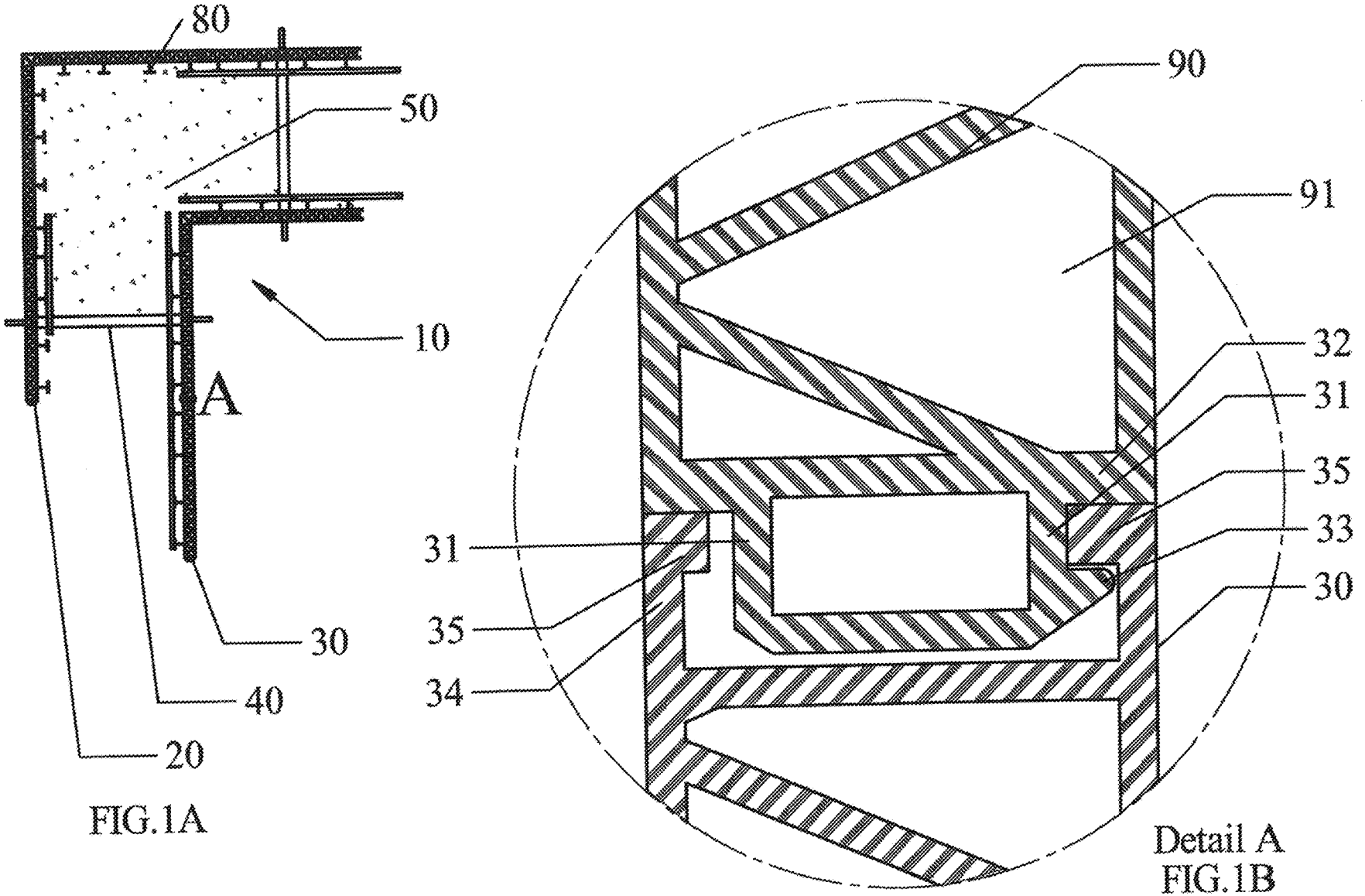
FIG. 1A is a top plan view of a modular wall at a corner of a building, in accordance with one embodiment.
FIG. 1B shows detail A of FIG. 1 depicting a first end of a first inner panel connected securely to an opposite end of a second inner panel, in accordance with one embodiment.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Applicant has discovered that it is possible to save time and effort during the construction process while utilizing a better apparatus and method.

Certain embodiments disclose an Optimized Engineering Yield & Efficiency (OEYE) system. It provides a high-performance modular formwork solution for construction that integrates advanced polymer materials with a unique visual monitoring feature, allowing real-time quality control, structural integrity verification, and improved efficiency in concrete casting. This technology eliminates the need for traditional removable formwork, reduces construction time, costs, and environmental impact, while enhancing insulation and waterproofing performance.

Certain embodiments involve constructing the outer wall of a building foundation where the construction is of the kind that involves pouring concrete between vertical panels. In many cases, this involves constructing what will become the basement of a building.

In traditional construction methods, temporary wooden formwork must be removed after concrete pouring, which prolongs work time, wastes materials, and increases costs. The proposed solution integrates polymer panels that remain as a permanent part of the structure, eliminating the need for formwork removal, reducing labor time, and significantly lowering costs.

Instead of using temporary wooden panels that have to be removed after the casting of the concrete, permanent panels made of a polymer are employed. The polymeric materials are used as the mold with which to build the frame for pouring the concrete. They do not need to be removed and they do not need a sealing layer to be added to the outside portions thereof. They are also cheaper and lighter than wood panels. This means there will be no need to remove the wood after casting, and the polymeric product will remain permanently in place. As a result, it will eliminate the need for waterproofing, plastering, and thermal insulation—all major advantages. Additionally, it will save time, labor, and the dismantling of the formwork, which is the wooden panels.

The apparatus and method described herein shortens construction time by approximately 30% and reduces labor costs by around 20%, as it eliminates the need for formwork removal. Additionally, the panels have improved waterproofing properties, reducing the need for additional waterproofing layers and minimizing external waterproofing work. This results in significant savings in material and labor costs while maintaining a high level of waterproofing performance over time.

The outer panels and inner panels together are sometimes referred to herein as a new formwork.

In some cases, for enhanced quality control, one or more of the outer and inner panels are transparent or semi-transparent to allow visibility to verify that the concrete properly fills the wall.

The modular panels—both inner and outer—can be joined together securely to form the wall in a highly efficient manner because the structure of the edges of each panel are configured to snap and slid together in a locked connection, in some embodiments.

The panels may also comprise reinforcing ribs that define spaces for better insulation and structural integrity. The reinforcing ribs are also transparent or translucent in some embodiments, ensuring minimal impact on the overall transparency of the panel. Their design therefore maintains both structural integrity and visual clarity.

The system is suitable for a wide range of applications beyond standard construction, including pre-fabricated wall sections, rapid deployment structures for disaster zones, cleanroom wall coverings, acoustic barriers for highways, and specialized uses such as underground structures and cold storage facilities.

The principles and operation of a Modular Construction System for Permanent Formwork may be better understood with reference to the drawings and the accompanying description.

As shown in FIG. 1A, a modular wall 10 is—or is part of—a permanent external formwork of a building (the building not shown). The modular wall 10 may comprise outer panels 20 and inner panels 30, each made of a thermoplastic polymer. One non-limiting example of such a thermoplastic polymer is polypropylene. One further non-limiting example of such a thermoplastic polymer is polypropylene homopolymer (one example of which is Capilene®, a product produced by Carmel Olefins Ltd, a company based in Israel). This thermoplastic polymer has excellent transparency.

In general, the panels 20, 30 are made of a thermoplastic polymer, including but not limited to polypropylene, polyamides, polycarbonate, or their composites. These materials have been selected for their high structural strength, chemical and moisture resistance, and insulation properties, serving as a permanent alternative to temporary formwork materials.

Outer panels 20 and inner panels 30 have an improved thermal insulation system. Specifically, panels 20, 30 are made of a polymer material with a low thermal conductivity coefficient, thereby providing enhanced thermal insulation compared to traditional construction methods. This property reduces heat transfer through walls, improves the building's energy efficiency, and contributes to lower heating and cooling costs over time. In some embodiments, the panels 20, 30 is made of high-impact polypropylene, which has a thermal conductivity coefficient ranging between 0.1 and 0.22 W/m·K, depending on the material composition.

Figure 2B:
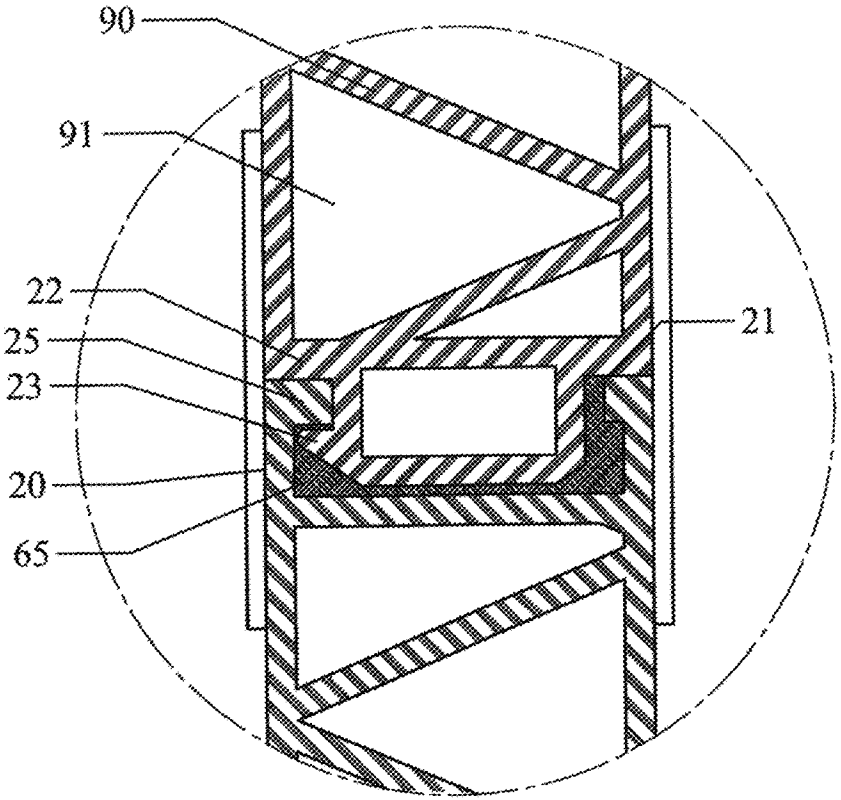
FIG. 2B shows detail B of FIG. 2A depicting a first end of a first outer panel connected securely to an opposite end of a second outer panel, in accordance with one embodiment.
Figure 2A:
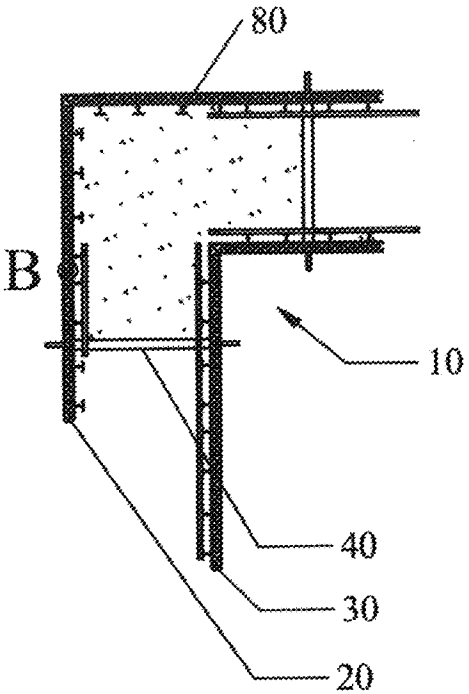
FIG. 2A is a top plan view as in FIG. 1A except highlighting detail B, in accordance with one embodiment.

Modular wall 10 may comprise a series of outer panels 20 made of a thermoplastic polymer. As best seen in FIG. 2B, each of the outer panels 20 may have a first end 22 and an opposite end 24. FIG. 1A and FIG. 2A also shows that inward of the series of outer panels 20 is positioned a series of inner panels 30 substantially parallel to the outer panels 20 and also made of a thermoplastic polymer, for example of the same thermoplastic polymer. As best seen from FIG. 1B, each of the inner panels 30 has a first end 32 and an opposite end 34. The inner panels 30 and the outer panels 20 are configured to remain in place as a permanent structure after a casting (pouring and drying) of the concrete 50, rather than being removed as in the prior art.

Figure 6:
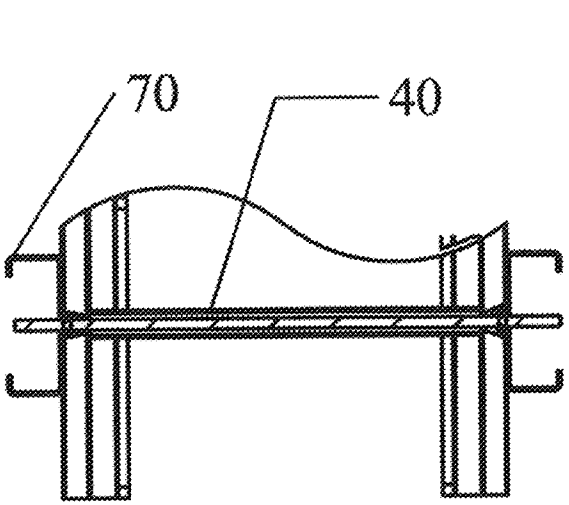
FIG. 6 shows a sectional view along line A—A of FIG. 5, in accordance with one embodiment.
Figure 5:
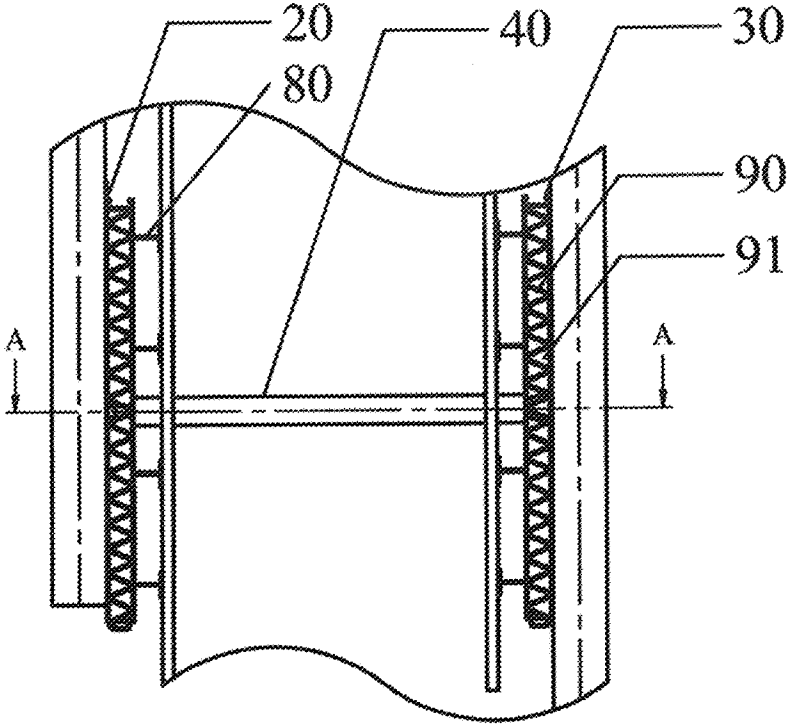
FIG. 5 is a top plan view of an outer panel and an inner panel and a reinforcement pipe between them, in accordance with one embodiment.

As shown in FIG. 5 and FIG. 6, for additional strength during the casting process (pouring the concrete and letting it dry) stability, wall 10 also includes reinforcing metal pipes 40 that substantially orthogonally connect each outer panel 20 to a corresponding portion of an inner panel 30. The term "corresponding" refers to the inner panel that faces the outer panel such that the two can be connected by a pipe 40 that is substantially orthogonal to the inner and the outer panels.

The reinforcing pipes 40 provide structural stability but do not interfere with the pouring of the concrete 50 since, in some embodiments, the pipes 40 occupy less than 5% (and in other embodiments less than 4% and in other embodiments less than 2% or less than 1% or less than 10%) of the space between the corresponding inner panel and the substantially orthogonal outer panel 20, the space where the concrete is to be poured. The reinforcing pipes 40 also occupy only a little portion of the space between the panels to make sure that the pipes 40 do not obstruct the network of metal wires 99 called rebar—that is to be placed between the inner 30 and outer panels 20 so as to strengthen the concrete 50.

Figure 4:
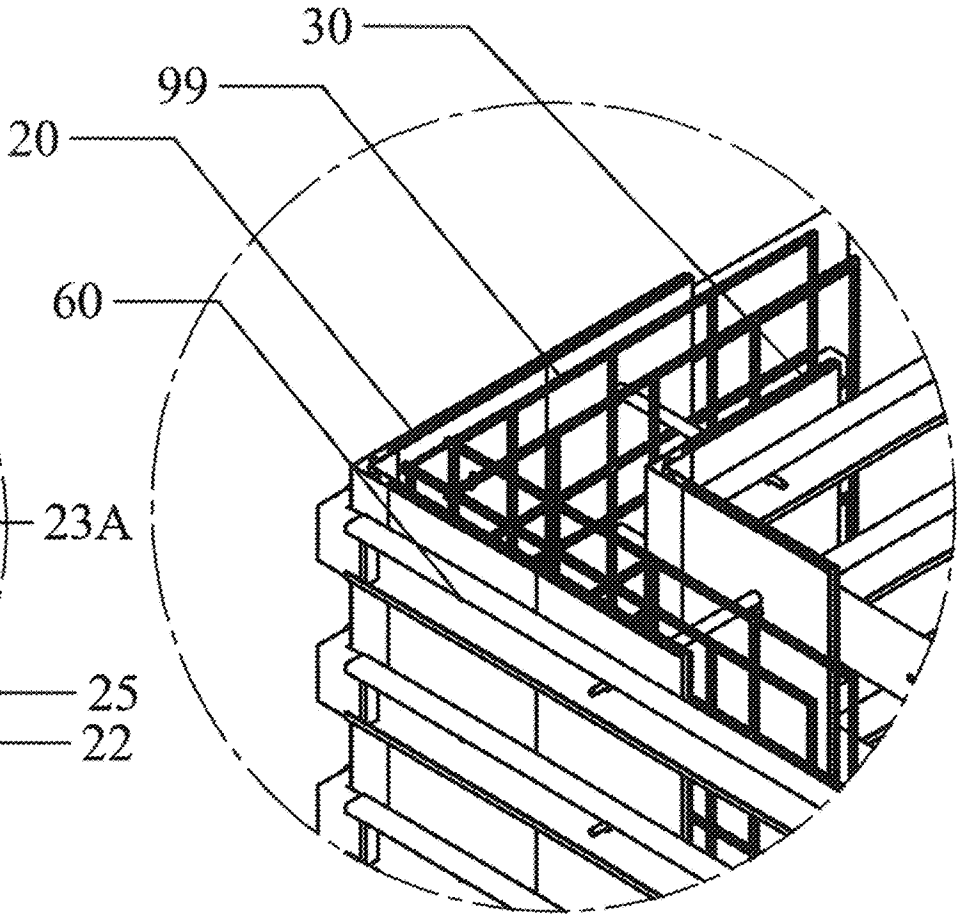
FIG. 4 is a perspective view showing a corner of the building frame including the rebar during the casting process, in accordance with one embodiment.

The purpose of the reinforcing pipes 40 is not only to provide strength during the process of mold casting but also in order to maintain a uniform spacing between the outer panels 20 and inner panels 30 during the pouring of the concrete. The uniform spacing counteracts the natural outward pressure against the panels 20, 30 generated from the outward push of the concrete that urges the panels 20, 30 away from one another. The pipes 40 also maintain uniform spacing between the outer panels 20 and the inner panels 30 after the construction is complete. In addition, the reinforcing pipes 40 are used to connect external supports 60 during the stage of the pouring of the concrete, as shown in FIG. 4.

In some embodiments, reinforcing pipes 40 are made of iron. Pipes 40 may contain internal threads for attachment to the panels 20, 30.

As shown clearly from FIG. 1A. FIG. 2A and FIG. 5, in any embodiment described herein, an additional feature that may be included is a T-shaped element 80 comprising a leg and a crossbar that is attached to at least some of the outer panels 20 via a leg of the T-shaped element 80 and that projects toward an area between the inner panels 30 and the outer panels 20, and similarly the T-shaped element 80 may also be attached to at least some of the inner panels 30 via a leg of the T-shaped element 80 and projects toward the area between the inner panels 30 and the outer panels 20.

Figure 7:
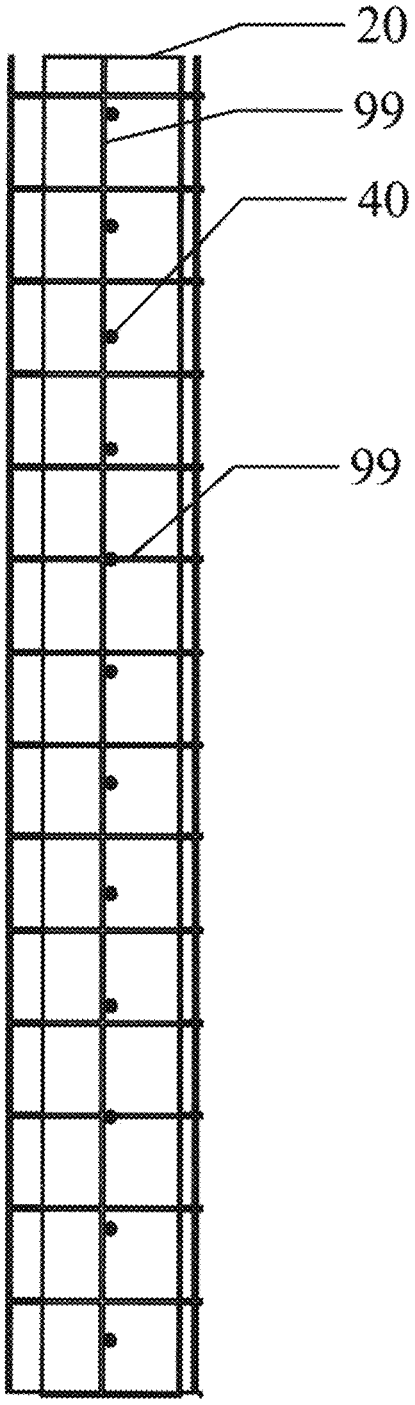
FIG. 7 shows a side view of a transparent outer panel, in accordance with one embodiment.

Although as seen in the particular non-limiting illustration of a single outer panel 20 of FIG. 7, the height of the panel 20 is much greater than the width of the panel 20, this is not a limitation or a requirement, and the construction apparatus and method described herein is suitable for a wide range of applications beyond standard construction.

The panels 20, 30 include an enhanced locking mechanism. In particular, outer panels 20 and inner panels 30 include an integrated locking mechanism that allows connection via snapping, sliding, or flexible joints. This mechanism enables quick, stable, and adaptable installation based on structural requirements, ensuring a strong and durable connection.

Accordingly, with respect to both the series of outer panels 20 and the series of inner panels 30, each panel of the series of panels is easily and quickly attached to its neighboring panel. For example, a first end 22 of a first outer panel 20 is configured to fit into an opposite end 24 of a second outer panel either using a sliding motion or using a snapping motion to form a first locking connection.

Similarly, a first end 32 of a first inner panel 30 is configured to fit into an opposite end 34 of a second inner panel either using a sliding motion or using a snapping motion to form a second locking connection, FIG. 1B and FIG. 2B depict two panels being joined together. The panels shown in FIG. 2B are outer panels 20. FIG. 1B shows a similar view for inner panels 30. As shown in FIG. 2B, the first end 22 of each outer panel 20 comprises a projecting head 21 and the opposite end 24 of each outer panel 20 comprises a flange 25. As shown in FIG. 1B, the first end 32 of each of the two inner panels 20 comprises a projecting head 31 and the opposite end 34 of each inner panel 30 comprises a flange 35.

In some implementations, the projecting heads 21, 31 may comprise a neck on each side of the panel and a tooth 23, 33 on one side. The projecting head 21, 31 may be flexible to be able to move past the side or sides of the flange 25, 35. Once the two panels are joined together by snapping or sliding they are locked and the projecting head 21, 31 cannot be dislodged by moving in a reverse direction.

In some embodiments, as shown in FIG. 1B and FIG. 2B, the projecting head 21, 31 may have asymmetrical teeth. For example, as shown in FIG. 1B and FIG. 2B, the projecting head 23, 33 may have a long tooth 23, 33 on one side. The long tooth 23, 33 is on the side that faces away from the concrete (i.e. away from the space between the inner panels and the outer panels where the concrete is poured). This allows the long tooth 23, 33 to engage one side of the flange 25, 35 while the other side of the panel can be angled in directly without having to situate one outer panel 20 (or one inner panel 30) above the other outer panel (or inner panel) before sliding, although the situating and sliding option is also available. Thus, the outer panel 20 and the inner panel 30 can be snapped or slid together rapidly and with more than one manner of attachment.

In the embodiment shown in FIG. 1B and FIG. 2B, the joining of the flange 25, 35 and the projecting head 21, 31 is such that the first locking connection is able to be implemented by either (A) positioning the first end 22 of the first outer panel 20 and the opposite end 24 of the second outer panel 20 facing each other at an angle, inserting the tooth of the projecting head 21 that exists on a side distal to the space beyond the flange 25 and snapping the first outer panel 20 into the second outer panel 20. The snapping may be accomplished by angling the first end 22 with the projecting head 21 so that the long tooth 23 can pass the side of the flange 25 that is on the same side as the long tooth 23, and then snapping the two ends together by reversing the angling motion. Alternatively, one can position the two panels end to end (i.e. the first end 22 of the first outer panel 20 and the opposite end 24 of the second outer panel 20) but with one of them just above the other panel and then after positing the projecting head to be adjacent but beyond the flange slide one of the panels (typically the panel being held above the other panel) into the other one by lowering that panel in a sliding motion to form the locking connection.

In certain embodiments, the panels 20, 30 may be connected using detachable clip reinforcements (not shown), allowing for easy disassembly and reassembly. This feature makes the system ideal for modular and industrial construction projects, as well as for applications requiring material recycling and reuse.

In some embodiments, one or both of the series of outer panels 20 and the series of inner panels 30 are transparent or semi-transparent (i.e. translucent), allowing for real-time quality control during concrete pouring while maintaining structural integrity. This feature is an auxiliary quality control tool that helps identify one, both or all three of: (a) defects, (b) large air pockets, and (c) inconsistencies in material density or areas where the concrete has not been evenly distributed or properly spread, thereby ensuring a higher-quality result. In one example, the series of outer panels 20 is transparent or semi-transparent and the series of inner panels 30 is opaque (or vice-versa). In another example, outer panels 20 are semi-transparent and inner panels 30 are transparent (or vice versa). In some cases, both the inner panel 30 and the outer panel 20 are transparent. In other embodiments, neither are transparent. It should be noted that "transparent" and "semi-transparent" (or translucent) mean transparent or semi-transparent (or translucent) at least during the construction stage while the concrete casting occurs. This allows one to see whether the concrete is properly filling the space between the outer panels 20 and the inner panels 30. As a result, the quality control process is enhanced. The fact that afterwards a user of the building that was built may opt to paint the wall and render it no longer transparent does not negate the fact that the panel 20, 30 is transparent during the construction stage.

In some embodiments, at least one of the series of outer panels 20 and the series of inner panels 30 comprises a transparent polypropylene homopolymer.

Figure 3:
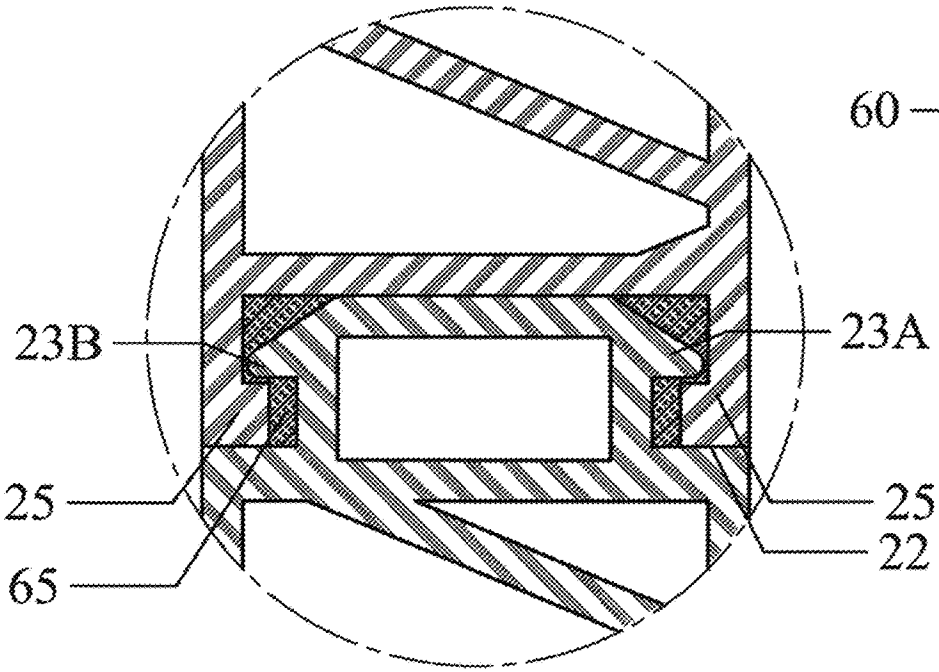
FIG. 3 shows a version of a connection between one end of one outer panel and a opposite end of a second outer panel in which the projecting head of one end of the outer panels has symmetrical teeth, in accordance with one embodiment.

As shown in FIG. 3, in one particular embodiment, the first end of each outer panel 20 (and the same thing applies to the inner panel 30) comprises a projecting head 21 having symmetrical teeth 23A, 23B on each side of the projecting head 21. The two sides are the side that is distal to the space between the inner panels 30 and outer panels 20 (where the concrete is poured) and the side that is proximal to the space between the inner panels 30 and the outer panels 20. The opposite end 24 of each outer panel 20 (in FIG. 3 this is shown as the opposite end 24 of a second outer panel 20 being joined to the first end of the first outer panel 20) comprises a flange 25, such that the first locking connection is implemented by positioning the first end 22 of the first outer panel and the opposite end 24 of the second outer panel one above the other, inserting the projecting head beyond the flange and sliding the first outer panel 20 into the second outer panel 20. In this embodiment, a direct face to face attachment cannot be accomplished due to the symmetrical and long teeth of the projecting head 23, 33.

As shown in FIG. 1B and FIG. 2B, in some embodiments, each of the outer panels 20 and/or each of the inner panels 20 comprise two substantially parallel walls separated by a pattern of reinforcing ribs 90 that together with the substantially parallel walls define spaces 91 for heat insulation. As a result of the presence of these space-defining reinforcing ribs 90, there is no need to add any special heat insulating material. Moreover, the reinforcing ribs 91 are also transparent or translucent in some embodiments (and may be made from a thermoplastic polymer having excellent transparency (such as Capilene®) that is of the same material as the substantially parallel walls of the panels 20, 30), thereby ensuring minimal impact on the overall transparency of the panel 20, 30. Accordingly, the reinforcing ribs 90 maintains both structural integrity and visual clarity. The fact the ribs 91 are made from the same transparent thermoplastic material as the panel 20, 30, ensures consistency in both structure and transparency, thereby allowing the panel to maintain its clarity while benefiting from the added strength of the reinforcing ribs 91.

In some versions, as can be seen by FIG. 1B and FIG. 2B (and as also seen in the outer panels 20 and inner panels 30 of FIG. 5), the spaces 91 defined by the ribs 90 are substantially in the shape of a triangle 91. This is not a requirement, however, and other shapes are possible. Nonetheless, a substantially triangular shape is one particular shape that provides added structural integrity in an efficient manner.

The reinforcing ribs 90 are configured to strengthen the panels 20, 30 and to obtain a hard and load-resistant surface.

In cases where enhanced structural strength is required, external connectors or angular reinforcements may be incorporated between the panels. These solutions allow better adaptation to challenging site conditions, such as seismic zones, high-rise buildings, and locations subject to significant dynamic loads.

As shown in FIG. 4, for example, external supports 60 may be attached to the outer panels 20 (and in some cases also to the inner panels 30). In some case, the reinforcing pipes 40 are configured to attach to the external supports 60 during a stage of a pouring of the concrete 50.

As shown in FIG. 5 and FIG. 6, at least some of either the inner panels or the outer panels may include a U-shaped projection 70 (as defined to be a boxy U-shape). In some implementations, the legs 71 of the "U" of the U-shaped projection 70 are substantially perpendicular to an inner panel or to an outer panel that the U-shaped projection 70 projects from. As seen from FIG. 6, the U-shaped projection may be external to the panels 20, 30. In some embodiments, the U-shaped projection 70 projects toward an area between the inner panels 30 and the outer panels 20. As used herein, the term "U-shaped" refers to a boxy U-shape as opposed to a rounded U-shape.

The purpose of these projections 70 is for support (to help reinforce the structure) and to maintain stability during the pouring of the concrete process so that the concrete does not push the panels away from one another, as well as to connect different formwork elements.

As stated, the polymer panels are configured to connect modularly to each other using a "lock" connection". This is shown in FIG. 1B, FIG. 2B and FIG. 3 where each edge of a panel 20,30 connects to the corresponding edge of a second adjacent panel 20, 30.

The locking mechanism may include integrated silicone material 65 (FIG. 2B, FIG. 3), thereby creating a sealed connection that reduces water penetration. This feature enhances the building's durability and minimizes the need for additional waterproofing applications. As seen in FIG. 2B, for example silicone 65 may be situated inside the locking area to seal the connection against water, for example from water coming from the outside of the building going to the inside of the building (i.e. to help prevent basements or other rooms from becoming damp).

Another embodiment of the modular wall 10 is a wall that is (or is part of) a permanent external formwork of a building, comprising:

- a series of outer panels made of a polymer, each of the outer panels having a first end and an opposite end;
- a series of inner panels substantially parallel to the outer panels and made of a polymer, each of the inner panels having a first end and an opposite end;
- a first end of a first outer panel fits into an opposite end of a second outer panel using either a sliding motion or a snapping motion to form a first locking connection,
- a first end of a first inner panel fits into an opposite end of a second inner panel using either a sliding motion or a snapping motion to form a second locking connection,
- wherein the inner panels and the outer panels are configured to remain in place as a permanent structure after a casting of concrete.
- wherein the first end of the first outer panel comprises a projecting head and the opposite end of the second outer panel comprises a flange such that the first locking connection is implemented by positioning the first end of the first outer panel and the opposite end of the second outer panel facing each other or with one above the other, inserting the projecting head beyond the flange and sliding or snapping the first outer panel into the second outer panel.

All of the versions described with respect to the embodiment with the pipes 40 also apply to this version without the pipes 40. For example, in some versions, the first end of each outer panel may comprise a projecting head and the opposite end of each outer panel comprises a flange such that the first locking connection is able to be implemented by either (A) positioning the first end of the first outer panel and the opposite end of the second outer panel facing each other at an angle, inserting a tooth of the projecting head that exists on a side distal to the space beyond the flange and snapping the first outer panel into the second outer panel or (B) positioning the first end of the first outer panel and the opposite end of the second outer panel one above the other, inserting the projecting head beyond the flange and sliding the first outer panel into the second outer panel.

In other versions, the first end of each outer panel comprises a projecting head having symmetrical teeth distal to and proximal to the space, and the opposite end of each outer panel comprises a flange, such that the first locking connection is implemented by positioning the first end of the first outer panel and the opposite end of the second outer panel one above the other, inserting the projecting head beyond the flange and sliding the first outer panel into the second outer panel.

In addition, the panels 20, 30 may be transparent, the walls may have reinforcing ribs 90 (as in the shape depicted in FIG. 1B, FIG. 2B, FIG. 3 and FIG. 5), silicone fillers 65 or rubber gaskets may be utilized, external supports 60 may be included, boxy U-shaped projections 70 may be added.

Another embodiment is a modular wall 10 that is, or is at least part of, a permanent external formwork of a building, comprising:

- a series of outer panels 20 made of a polymer, each of the outer panels having a first end and an opposite end;
- a series of inner panels 30 substantially parallel to the outer panels and made of a polymer, each of the inner panels having a first end and an opposite end;
- reinforcing metal pipes 40 connecting each outer panel to a corresponding inner panel, the reinforcing pipes occupying less than 5% of a space between the corresponding inner panel and the corresponding outer panel;
- a first end 22 of a first outer panel 20 is configured to fit into an opposite end 24 of a second outer panel 20 either using a sliding motion or using a snapping motion to form a first locking connection,
- a first end 32 of a first inner panel 30 is configured to fit into an opposite end 34 of a second inner panel 30 either using a sliding motion or using a snapping motion to form a second locking connection,
- wherein the inner panels and the outer panels are configured to remain in place as a permanent structure after a casting of concrete 50,
- wherein each of the outer panels and each of the inner panels comprise two substantially parallel walls separated by a pattern of reinforcing ribs 90 that together with the substantially parallel walls define spaces for heat insulation. In some embodiments, the spaces are substantially triangular. In some versions, a silicone gasket 65 is situated at a point where the first end of one panel 20, 30 adjoins an opposite end of a second adjacent panel 20, 30 (whether an inner panel 30 or an outer panel 20). In some versions, a boxy U-shaped projection is attached to the outer panels 20 or to the inner panels 30.

Figure 8:
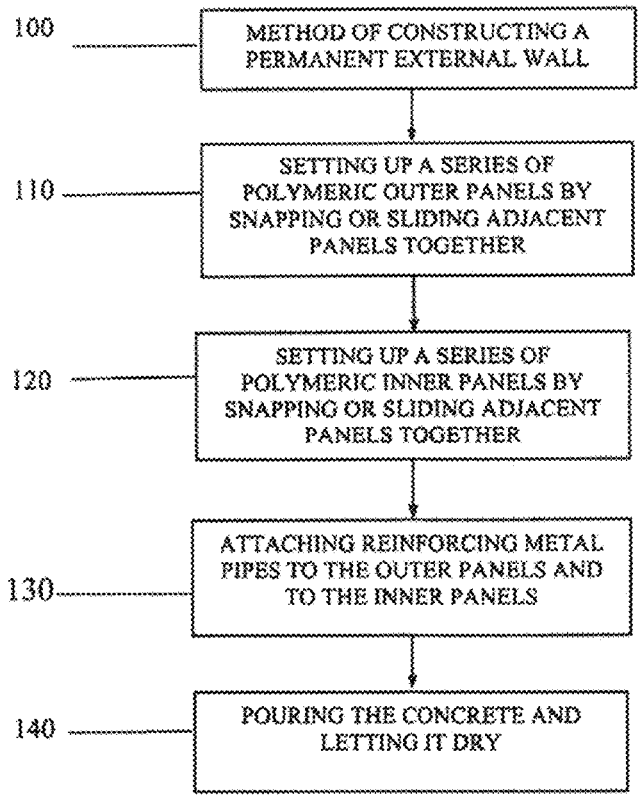
FIG. 8 is a flow chart showing a method, in accordance with one embodiment.

Another embodiment, as shown in FIG. 8, is a method 100 of constructing a permanent external formwork for a building. Method 100 may include a step 110 of setting in place in a vertical position a series of outer panels 20 made of a polymer, by joining together adjacent outer panels 20. As seen from FIG. 2B, method step 100 may be implemented by having a first end 22 of each outer panel 20 comprises a projecting head 21 and an opposite end 24 comprises a flange, such that the first end 22 of a first outer panel 20 connects to the opposite end 24 of the adjacent second outer panel 20 by placing the first end of the first outer panel facing the opposite end of the second outer panel and snapping them together. This may be accomplished by angling the first end 22 with the projecting head 21 so that the tooth 23 can pass the side of the flange 25 that is on the same side as the tooth 23, and then snapping the two ends together by reversing the angling motion to form a first locking connection. Alternatively, one can position the two panels end to end (i.e. the first end 22 of the first outer panel 20 and the opposite end 24 of the second outer panel 20) but with one of them just above the other panel and then after positing the projecting head to be adjacent but beyond the flange slide one of the panels (typically the panel being held above the other panel) into the other one by lowering that panel in a sliding motion to form the first locking connection.

Step 120 of method 100 may involve setting in place in a vertical position a series of inner panels substantially parallel to the outer panels and made of a polymer, by joining together adjacent inner panels, wherein a first end of each inner panel comprises a projecting head and an opposite end of the inner panel comprises a flange. A first end 32 of a first inner panel 30 connects to an opposite end 34 of an adjacent second inner panel 30 using a snapping motion or using a sliding motion to form a second locking connection. This may be accomplished by angling the first end 32 with the projecting head 31 so that the tooth 33 can pass the side of the flange 35 that is on the same side as the tooth 33, and then snapping the two ends together by reversing the angling motion to form a second locking connection. Alternatively, one can position the two panels end to end (i.e. the first end 22 of the first outer panel 20 and the opposite end 24 of the second outer panel 20) but with one of them just above the other panel and then after positing the projecting head to be adjacent but beyond the flange slide one of the panels (typically the panel 20 being held above the other panel 20) into the other one by lowering that panel in a sliding motion to form the locking connection. The order of steps 110 and 120 may be reversed—the inner panels 30 may be set up before the outer panels 20.

In steps 110 and 120, one or both of the outer panels 20 and the inner panels 30 are transparent.

The structure of the panels 20, 30 may be any of the versions described with respect to wall 10.

Method 100 may further include a step 130 of attaching reinforcing metal pipes to the outer panels and to corresponding portions of the inner panels, the reinforcing pipes occupying less than 5% of a space (or less than 4% or 3% or 2% or 1% or less than 10%) between each particular outer panel of the series of outer panels and a particular inner panel of the series of inner panels that faces the particular outer panel.

Method 100 may have a step 140 of pouring concrete between the inner panels and the outer panels so as to occupy the space between the series of outer panels and the series of inner panels.

In method 100, the inner panels and the outer panels are configured to remain in place as a permanent structure after the concrete has been cast.

As in other embodiments, in some versions of method 100, there may be a step of forming the first locking connection by either (A) positioning the first end of the first outer panel and the opposite end of the second outer panel facing each other at an angle, inserting a tooth of the projecting head that exists on a side distal to the space beyond the flange and snapping the first outer panel into the second outer panel or (B) positioning the first end of the first outer panel and the opposite end of the second outer panel one above the other, inserting the projecting head beyond the flange and sliding the first outer panel into the second outer panel.

In some versions of method 100, a step involves forming the first locking connection by positioning the first end of the first outer panel and the opposite end of the second outer panel one above the other, inserting the projecting head beyond the flange and sliding the first outer panel into the second outer panel, wherein the projecting head has symmetrical teeth.

A version of method 100 may also involve providing the outer panels and the inner panels with two substantially parallel walls separated by a pattern of reinforcing ribs that together with the substantially parallel walls define spaces for heat insulation.

Some versions of method 100 include attaching external supports to the outer panels and to the inner panels so as to connect the outer panels and the inner panels to the reinforcing pipes during the pouring of the concrete.

Any of the other physical features described with respect to wall 10 may also be included in the method 100 of constructing a permanent building wall.

The apparatus, system and method described herein is designed for large-scale commercial and residential projects, offering a sustainable, reusable, and high-performance alternative to traditional construction methods. The system, apparatus and method includes outer panels and inner panels that are configured to be used in pre-fabricated structures, rapid deployment housing, and infrastructure projects requiring advanced insulation and waterproofing.

While the invention has been described with respect to a limited number of embodiments, it will be appreciated that many variations, modifications and other applications of the invention may be made. Therefore, the claimed invention, as recited in the claims that follow, is not limited to the embodiments described herein.

What is claimed is:

1. A modular wall that is a substantially linear permanent external formwork of a building, the modular wall having a length and a height, and comprising:

a series of outer panels made of a thermoplastic polymer, each of the outer panels having a first end and an opposite end;

a series of inner panels substantially parallel to the outer panels and made of the thermoplastic polymer or another thermoplastic polymer, each of the inner panels having a first end and an opposite end;

reinforcing metal pipes connecting each outer panel to a corresponding inner panel;

a first end of a first outer panel (a) is configured to fit into an opposite end of a second outer panel to form a first locking connection by using an option of a sliding motion and (b) is configured to fit into the opposite end of the second outer panel by using an option of an end to end joining motion that includes positioning the first end of the first outer panel and the opposite end of the second outer panel facing each other at an angle and then joining the first outer panel, a first end of a first inner panel (a) is configured to fit into an opposite end of a second inner panel to form a second locking connection by using an option of a sliding motion and (b) is configured to fit into the opposite end of the second inner panel by using an option of an end to end joining motion that includes positioning the first end of the first outer panel and the opposite end of the second inner panel facing each other at an angle and then joining the first inner panel to the second inner panel, wherein the inner panels and the outer panels are configured to remain in place as a permanent structure after a casting of concrete, wherein each of (i) the sliding motion that forms the first locking connection and (ii) the sliding motion that forms the second locking connection is in a direction substantially parallel to the height of the modular wall and wherein each of the end to end joining motions is in a direction substantially parallel to the length of the modular wall; and wherein each of the outer panels and each of the inner panels comprise two substantially parallel walls separated by a pattern of reinforcing ribs that together with the substantially parallel walls define spaces for heat insulation.

2. The modular wall of claim 1, wherein the first end of each outer panel comprises an asymmetric projecting head and the opposite end of each outer panel comprises a flange such that the first locking connection is able to be implemented using the option of the end to end joining motion by inserting beyond the flange a tooth of the projecting head that exists on a side distal to a space between a particular inner panel and a corresponding outer panel at the angle so as to join the first outer panel into the second outer panel.

3. The modular wall of claim 2, wherein one or both of the outer panels and the inner panels are transparent.

4. The modular wall of claim 1, wherein one or both of the outer panels and the inner panels are transparent.

5. The modular wall of claim 1, wherein at least one of the series of outer panels and the series of inner panels comprises a transparent polypropylene homopolymer.

6. The modular wall of claim 1, wherein the spaces are substantially triangular.

7. The modular wall of claim 1, further comprising external supports attached to the outer panel and to the inner panel, wherein the reinforcing pipes are configured to attach to the external supports during a stage of a pouring of the concrete.

8. The modular wall of claim 1, wherein at least some of either the inner panels or the outer panels are shaped to include a U-shaped projection, wherein a leg of the "U" of the U-shaped projection is substantially perpendicular to an inner panel or to an outer panel that the U-shaped projection projects from.

9. The modular wall of claim 1, wherein the reinforcing metal pipes occupy less than 3% of a space between corresponding inner and outer panels.

10. The modular wall of claim 1, further comprising a silicone gasket between opposite outer walls of each panel of one or both of the outer panels and inner panels.

11. A modular wall that is a substantially linear permanent external formwork of a building, the modular wall having a length and a height and comprising:

a series of outer panels made of a thermoplastic polymer, each of the outer panels having a first end and an opposite end;

a series of inner panels substantially parallel to the outer panels and made of the thermoplastic polymer or another thermoplastic polymer, each of the inner panels having a first end and an opposite end;

a first end of a first outer panel is configured to fit into an opposite end of a second outer panel using an option of a sliding motion and is configured to fit into the opposite end of the second outer panel using an option of an end to end joining motion, to form a first locking connection, a first end of a first inner panel is configured to fit into an opposite end of a second inner panel using an option of a sliding motion and is configured to fit into the opposite end of the second inner panel using an option of an end to end joining motion, to form a second locking connection, wherein the inner panels and the outer panels are configured to remain in place as a permanent structure after a casting of concrete;

wherein the first end of the first outer panel comprises a projecting head and the opposite end of the second outer panel comprises a flange such that the first locking connection is implemented (a) using the option of the end to end joining motion by positioning the first end of the first outer panel and the opposite end of the second outer panel facing each other and inserting the projecting head at an angle beyond the flange so as to join the first outer panel and the second outer panel or (b) using the option of the sliding motion with the first outer panel above the second outer panel and sliding the first outer panel into the second outer panel, wherein each of (i) the sliding motion that forms the first locking connection and (ii) the sliding motion that forms the second locking connection is in a direction substantially parallel to the height of the modular wall and wherein each of the end to end joining motions is in a direction substantially parallel to the length of the modular wall; and wherein each of the outer panels and each of the inner panels comprise two substantially parallel walls separated by a pattern of reinforcing ribs that together with the substantially parallel walls define spaces for heat insulation.

12. The modular wall of claim 11, wherein the first end of each outer panel comprises an asymmetric projecting head and the opposite end of each outer panel comprises a flange such that the first locking connection is able to be implemented using the option of the end to end joining motion by inserting beyond the flange a tooth of the asymmetric projecting head that exists on a side distal to a space between a particular inner panel and a corresponding outer panel and joining the first outer panel into the second outer panel by reversing the angle.

13. The modular wall of claim 12, wherein one or both of the outer panels and the inner panels are transparent.

14. The modular wall of claim 11, wherein one or both of the outer panels and the inner panels are transparent or translucent.

15. The modular wall of claim 11, wherein at least some of either the inner panels or the outer panels are shaped to include a U-shaped projection, wherein a leg of the "U" of the U-shaped projection is substantially perpendicular to an inner panel or to an outer panel that the U-shaped projection projects from.

16. The modular wall of claim 11, further comprising external supports attached to the outer panel and to the inner panel and further comprising reinforcing pipes that are configured to attach to the external supports during a stage of a pouring of the concrete.

17. A method of constructing a substantially linear permanent external formwork for a building, the modular wall having a length and a height and comprising:

setting in place in a vertical position a series of outer panels made of a thermoplastic polymer, a first end of each outer panel comprising a projecting head and an opposite end comprising a flange, such that a first end of a first outer panel connects to an opposite end of an adjacent second outer panel by choosing an option of a sliding motion in a direction substantially parallel to the height, or an alternative option of an end to end joining motion in a direction substantially parallel to the length that includes positioning the first end of the first outer panel and the opposite end of the second outer panel facing each other at an angle, to form a first locking connection;

setting in place in a vertical position a series of inner panels substantially parallel to the outer panels and made of the thermoplastic polymer or another thermoplastic polymer, a first end of each inner panel comprising a projecting head and an opposite end comprising a flange, such that a first end of a first inner panel connects to an opposite end of an adjacent second inner panel by choosing the option of the sliding motion in the direction substantially parallel to the height, or the alternative option of the end to end joining motion in the direction substantially parallel to the length that includes positioning the first end of the first inner panel and the opposite end of the second inner panel facing each other at an angle, to form a second locking connection, wherein one or both of the outer panels and the inner panels are transparent;

attaching reinforcing metal pipes to the outer panels and to corresponding portions of the inner panels;

pouring concrete between the inner panels and the outer panels so as to occupy the space between the series of outer panels and the series of inner panels, wherein the inner panels and the outer panels are configured to remain in place as a permanent structure after the concrete has been cast; and providing the outer panels and the inner panels with two substantially parallel walls separated by a pattern of reinforcing ribs that together with the substantially parallel walls define spaces for heat insulation.

18. The method of claim 17, further comprising forming the first locking connection by choosing the alternative option of the end to end joining motion and inserting beyond the flange a tooth of the projecting head that exists on a side distal to the space between a particular outer panel and a corresponding inner panel so as to join the first outer panel into the second outer panel.

19. The method of claim 17, further comprising controlling a quality of the permanent external building wall by monitoring the pouring of the concrete by looking through at least one of the outer panels and the inner panels during the pouring of the concrete, wherein at least one of the outer panels and the inner panels are transparent, to identify at least one of defects, large air pockets and inconsistencies in either material density or concrete distribution.

20. The method of claim 17, further comprising attaching external supports to the outer panels and to the inner panels so as to connect the outer panels and the inner panels to the reinforcing pipes during the pouring of the concrete.

21. The modular wall of claim 1, wherein at least some of the outer panels are shaped to include a T-shaped element having a leg and a crossbar, the crossbar at a free end of the T-shaped element, the T-shaped element projecting into an area between the inner panels and the outer panels.

22. The modular wall of claim 11, wherein at least some of the inner panels are shaped to include a T-shaped element having a leg and a crossbar, the crossbar at a free end of the T-shaped element, the T-shaped element projecting into an area between the inner panels and the outer panels.

23. The modular wall of claim 1, wherein each of the sliding motion that forms the first locking connection, the end to end joining motion that forms the first locking connection, the sliding motion that forms the second locking connection and the end to end joining motion that forms the second locking connection is configured to be effectuated without bending the first end or the opposite end of either the outer panels or the inner panels.

24. The modular wall of claim 11, wherein each of the sliding motion that forms the first locking connection, the end to end joining motion that forms the first locking connection, the sliding motion that forms the second locking connection and the end to end joining motion that forms the second locking connection is configured to be effectuated without bending the first end or the opposite end of either the outer panels or the inner panels.

25. The method of claim 17, wherein each of the sliding motion that forms the first locking connection, the end to end joining motion that forms the first locking connection, the sliding motion that forms the second locking connection and the end to end joining motion that forms the second locking connection is configured to be effectuated without bending the first end or the opposite end of either the outer panels or the inner panels.

* * * * *